US005186319A

United States Patent [19]

Ting

[11] Patent Number: 5,186,319

[45] Date of Patent: Feb. 16, 1993

[54] TRANSPORT AND DISPLAY CASE FOR A FIGURINE

[75] Inventor: Charles Ting, Taipei, Taiwan

[73] Assignee: T. L. Products Promoting Co., Ltd., Taipei, Taiwan

[21] Appl. No.: 844,475

[22] Filed: Mar. 2, 1992

[51] Int. Cl.[5] ..... B65D 75/54

[52] U.S. Cl. ..... 206/45.14; 206/457; 446/73

[58] Field of Search ..... 206/45.14, 223, 457, 206/575, 579; 446/72, 73, 75, 77

[56] References Cited

U.S. PATENT DOCUMENTS

| | | | |
|---|---|---|---|
| 2,175,319 | 10/1939 | Rubenstein | 206/457 |
| 2,527,007 | 10/1950 | Golino | 206/457 |
| 2,823,490 | 2/1958 | Griem | 206/457 |
| 3,440,747 | 4/1969 | Oliver | 446/73 |
| 3,867,971 | 2/1975 | Hazan | 206/457 |
| 4,385,687 | 5/1983 | Dutcher | 206/45.14 |
| 4,453,629 | 6/1984 | Goldberg | 206/457 |
| 4,461,790 | 7/1984 | Snider | 206/457 |
| 5,064,398 | 11/1991 | Richardson | 206/457 |

*Primary Examiner*—Jimmy G. Foster

[57] ABSTRACT

An animal head figurine transport and presentation stand, having an animal head figurine with a head and neck, the stand having a generally planar bottom portion with the center of gravity of the stand and the figurine being within the bottom portion when the stand is upright. A generally planar front portion has a figurine retention means comprising an aperture defined by an edge and a plurality of slits extending away from the edge to define a plurality of subportions of the front portion, each defined by the edge and two adjacent slits, whereby the subportions may be flexed inwardly by the inserted neck so that the neck is retained by the edge or flexed surface. The stand also has a top, rear and side portions, defining a hollow compartment. At least one of the side portions has a flexible hinge area for providing access to the compartment for storing accessories for the figurine.

22 Claims, 4 Drawing Sheets

TRANSPORT AND DISPLAY CASE FOR A FIGURINE

BACKGROUND OF THE INVENTION

1. Field of the Invention

The present invention primarily relates to the field of display boxes and transport containers for consumer items, such as plush toys. It also relates to a specialized display for providing access to a head of a figurine while on display in a store, so that special features of the head may be examined by the consumer and features thereof presented by way of graphics printed on the display.

2. Description of the Prior Art

The art is replete with examples of display and/or transport stands for figurines. Usually, such containers are designed to prevent access to the figurine during shipping or display, or house the figurine within the compartment of the box with large apertures provided in the box for access. Further, such items as plush toys are often presented without a stand or transport container, because they are otherwise inefficient to transport. When toys are presented in a display, which is accessible, they are often held in place with twist ties, which require significant effort to install and remove.

When toy busts, which consist of head and neck, are ordinarily presented to consumers, the toy appears disembodied and surreal. This is compounded by, with the possible exception of humanoid busts, the non-physiological presentation of the toy. This problem is more acute when the toy has features which make marketing thereof easier if access to the toy in its working position is the sale context. In such a case, the normal presentation schemes diminish the attractive features of the toy and achieve suboptimal marketing potential.

SUMMARY OF THE INVENTION

It is an object of the present invention to provide a transport and display stand for a consumer article, comprising a generally planar bottom portion having such dimensions to provide stability for the article and stand when the article is supported by the stand, when said bottom portion rests on a planar surface; a generally planar rear portion extending upward from said bottom portion; a generally planar front portion, extending upward from said bottom portion at an inclination sloping backward toward said rear portion, said front portion having an article retention means comprising an aperture in said front portion defined by an edge and a plurality of slits in said front portion extending from said edge in a direction substantially perpendicular thereto, said slits extending for a distance to define a plurality of subportions of said front portion, each defined by said edge and two adjacent ones of said slits and which may be flexed inwardly from said front portion in the direction of said rear portion, so that the article, when inserted, flexes said subportions inwardly and is retained by said subportions acting against a part of the article; a top portion, extending between the upper edges of said front and rear portions; and two generally planar side portions, each extending from said bottom portion to said top portion, and from said front portion to said rear portion, said front, rear, top, bottom and side portions defining a hollow compartment in said stand, at least one of said side portions having a hinge area and being flexible along said hinge area for movement between an open position providing access to said compartment and a closed position in which access to said compartment is not provided.

In accordance with another aspect of the present invention, it is an object to provide a stand wherein said top, bottom, front, rear, and two side portions are formed from a single sheet, wherein said sheet may comprise cardboard. The cardboard may be a corrugated cardboard having two flat sheets and a corrugated sheet therebetween, and may further be corrugated cardboard which has a graphic printed on one face thereof.

It is a still further object of the present invention to provide a stand wherein said article retention means comprises said edge having a path which has a substantially continuous first derivative and said slits extend outwardly in a substantially radial direction from a center of the aperture. In an alternative embodiment, said article retention means comprises said edge having a path which has a substantially discontinuous first derivative and said slits extend outwardly in a generally radial direction from a center of the aperture.

It is an object of the present invention to provide, in the case of a substantially continuous first derivative of the surface of the edge of the article retention means, to provide a stand wherein said slits extend a distance approximately equal to a radial distance of the aperture. The aperture may be round and said slits of different lengths, so as to define an oval article retention means which is larger than the round aperture, when the article is inserted. Further, said article retention means may be located laterally eccentric in said front portion.

In accordance with a still further aspect of the present invention, it is an object to provide a stand wherein both of said side portions have hinge areas and are flexible along said hinge areas for movement between an open position, and a closed position, said hinge areas joining said front portion and said side portions, said side portions further comprising a slotted aperture formed at a junction of a rear edge of said side portions and a flexible tab protruding from said rearward edge thereof, said rear portion further comprising a tab at each respective lateral edge thereof for engaging said slotted aperture of said side portions. The stand may further comprise inner sidewall portions each comprising a portion which is hinged at, and extends from, said respective lateral edge of said rear portion, a first aperture corresponding to a shape of said tab extending from each respective lateral edge of said rear portion, and a vertical slotted aperture proximate to said respective lateral edge of said rear portion, intersecting said first aperture, so that said inner sidewall portion may be flexed at said respective lateral edge of said rear portion to form an inner sidewall, said sidewall may be flexed at said side hinge areas to form an outer sidewall, said flexible tab may be inserted in said vertical slotted aperture, and said tab may be inserted in said slotted aperture for engaging said side portions locking said stand in said closed position. Said tab at said lateral aspect of said rear portion may comprise two horizontal edges, a vertical edge, and two slits parallel to said horizontal edges, forming an elongated tab, a lateral edge hinge and an internal hinge, so that said lateral edge hinge may be displaced out of a plane of said rear portion and said vertical edge may be inserted into said slotted aperture with said lateral edge hinge in said plane of said rear portion. Said bottom portion may comprise a rear tab on a rear edge thereof and said back portion may comprise a bottom extension extending from a bottom edge thereof, having a horizontal slot in said bottom extension proximate to said bottom edge, for insertion of said rear tab thereinto. The stand may further comprise a second horizontal slot and a second rear tab for insertion thereinto, and two side extensions of said bottom portion extending respectively from two side edges thereof.

In accordance with a further aspect of the present invention, it is an object of the invention to provide a stand in which said top portion comprises a generally planar surface perpendicular to said rear portion, bounded laterally by said side portions, and said rear portion extends to a position above said top portion approximately coincident with the intersection of a plane of said rear portion and a plane of said front portion. Further, a part of said rear portion above said top portion comprises a dual folded layer of corrugated cardboard having an aperture therein for supporting the stand and the article on a generally horizontal post.

It is another object of the present invention to provide a stand in combination with an animal figurine having a head and a neck, wherein a center of gravity of said stand and said figurine, when inserted in said stand in an upright position, lies within said bottom portion, and said head assumes a physiological position extending from said front portion.

It is another object of the present invention to provide a transport and display stand for an animal figurine having a base and a head, comprising a generally planar bottom portion having such dimensions to provide stability for the figurine when the base thereof is inserted in the stand, when said bottom portion rests on a planar surface, so that a center of gravity of the stand and the inserted figurine, when the stand is upright, is superimposed on the bottom portion; a generally planar rear portion extending upward from said bottom portion; a generally planar front portion extending upward from said bottom portion at an inclination sloping backward toward said rear portion, said front portion having a figurine retention means comprising an aperture in said front portion defined by an edge and a plurality of slits in said front portion extending from said edge in a direction substantially perpendicular thereto, said slits extending for a distance to define a plurality of subportions of said front portion, each defined by said edge and two adjacent ones of said slits and which may be flexed inwardly from said front portion in the direction of said rear portion, so that the base, when inserted, flexes said subportions inwardly and is retained by said subportions acting against a part of the figurine; a top portion, extending between the upper edges of said front and rear portions; and two generally planar side portions, each extending from said bottom portion to said top portion, and from said front portion to said rear portion, said front, rear, top, bottom and side portions defining a hollow compartment in said stand, at least one of said side portions having a hinge area and being flexible along said hinge area for movement between an open position providing access to said compartment and a closed position in which access to said compartment is not provided.

A still further object of the present invention provides an animal head figurine transport and presentation stand, comprising an animal head figurine comprising a head and a neck; a generally planar bottom portion having such dimensions to provide stability for said figurine when said neck thereof is inserted in said stand, when said bottom portion rests on a planar surface, so that a center of gravity of the stand and said inserted figurine, when said stand is upright, is superimposed on the bottom portion; a generally planar rear portion extending upward from said bottom portion; a generally planar front portion, extending upward from said bottom portion at an inclination sloping backward toward said rear portion, said front portion having a figurine retention means comprising an aperture in said front portion defined by an edge and a plurality of slits in said front portion extending from said edge in a direction substantially perpendicular thereto, said slits extending for a distance to define a plurality of subportions of said front portion, each defined by said edge and two adjacent ones of said slits and which may be flexed inwardly from said front portion in the direction of said rear portion, so that said neck, when inserted, flexes said subportions inwardly and is retained by said subportions acting against a part of said figurine; a top portion, extending between the upper edges of said front and rear portions; and two generally planar side portions, each extending from said bottom portion to said top portion, and from said front portion to said rear portion, said front, rear, top, bottom and side portions defining a hollow compartment in said stand, at least one of said side portions having a hinge area and being flexible along said hinge area for movement between an open position providing access to said compartment and a closed position in which access to said compartment is not provided.

It is another object of the present invention to provide an animal head figurine transport and presentation stand further comprising accessories for said figurine, said accessories being stored in said compartment when said side portions are in said closed position, and said accessories being removable from said compartment when said side portions are in said open position. In the case of a hobby horse, the accessories comprise the hobby stick, which may be formed in a plurality of interfitting portions, preferably three. The animal head figurine may also be insertable into said compartment, for efficient transport.

The present invention provides a display and transport stand having superior presentation features and provides for efficient storage. Further, the stand also is manufacturable in a simple operation, as a single piece of cardboard with a graphic imprinted on one side. This punched sheet is then folded to produce the stand of the present invention.

A preferred embodiment of the present invention is a display and presentation stand for a hobby horse toy which produces electronic sounds when pressure is applied to the head. Since this is an attractive feature of the toy, the provision of access thereto in a retail environment is calculated to increase the salability of the product. Further, the preferred embodiment is highly detailed and of a high quality, so that full visibility of the product would allow the consumer to evaluate these aspects prior to purchase, and distinguish this product from lower quality products. Finally, the electronic sounds of the toy are produced by a speaker in a side of the neck, so that it is desirable to have at least that portion of the neck extending beyond the stand.

The present stand is for presentation of animal figurines and the like, especially quadrupeds, whose physiological angle of the neck, in gazing position, is, e.g. for a horse, approximately 30°-60° above horizontal. Thus, it is desired to present such a figurine at such an angle.

However, in order to secure the figurine in the stand, it is desired to provide an attachment which engages the oval neck portion in a plane normal to the axis of the neck. Therefore, for simplicity of construction, the present invention allows the figurine to be presented in a shallow stand, i.e. one which has a depth smaller than the depth of the figurine, by inclining the plane of the front portion at an angle of about 60°.

Thus, the stand of the present invention provides an improved presentation for the bust-like figurine at modest cost, while also serving as a transportation vehicle. In certain instances, the figurine may be placed totally inside of the case for space efficiency and protection during transport and storage. This feature, however, is not a required element of the design, and, in fact, many retailers prefer the goods require no preparation prior to display and sale, so that any advantage gained would likely be present during the transport between the point of manufacture and the point of distribution, a stage at which the importer or distributor has the most control.

The stand is designed for efficient assembly and attractiveness. The stand is also stable, and does not tend to topple in the preferred embodiment when the figurine is inserted. Thus, it remains upright. The figurine and the stand may also be shipped separately, so that the preparation for shipping to the retailer requires simply pushing the figurine into the stand. For ease of storage, a so inclined retailer may also insert the figurine himself.

BRIEF DESCRIPTION OF THE DRAWINGS

The invention will be described in further detail below with reference to the figures shown in the drawings, in which.

DETAILED DESCRIPTION OF THE PREFERRED EMBODIMENTS

Figure 8:
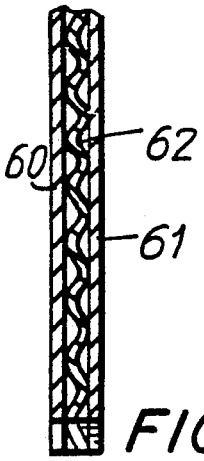
FIG. 8 shows a cross section of corrugated cardboard along section 8—8 of FIG. 7 of the present invention.
Figure 6:
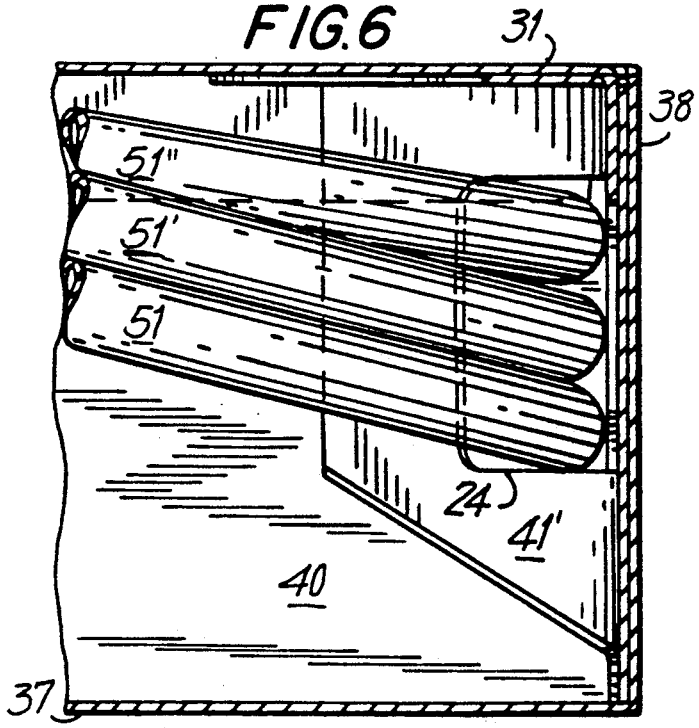
FIG. 6 shows a cross sectional view along section 6—6 of FIG. 5, showing the retention of the hobby stick segments of the present invention.
Figure 5:
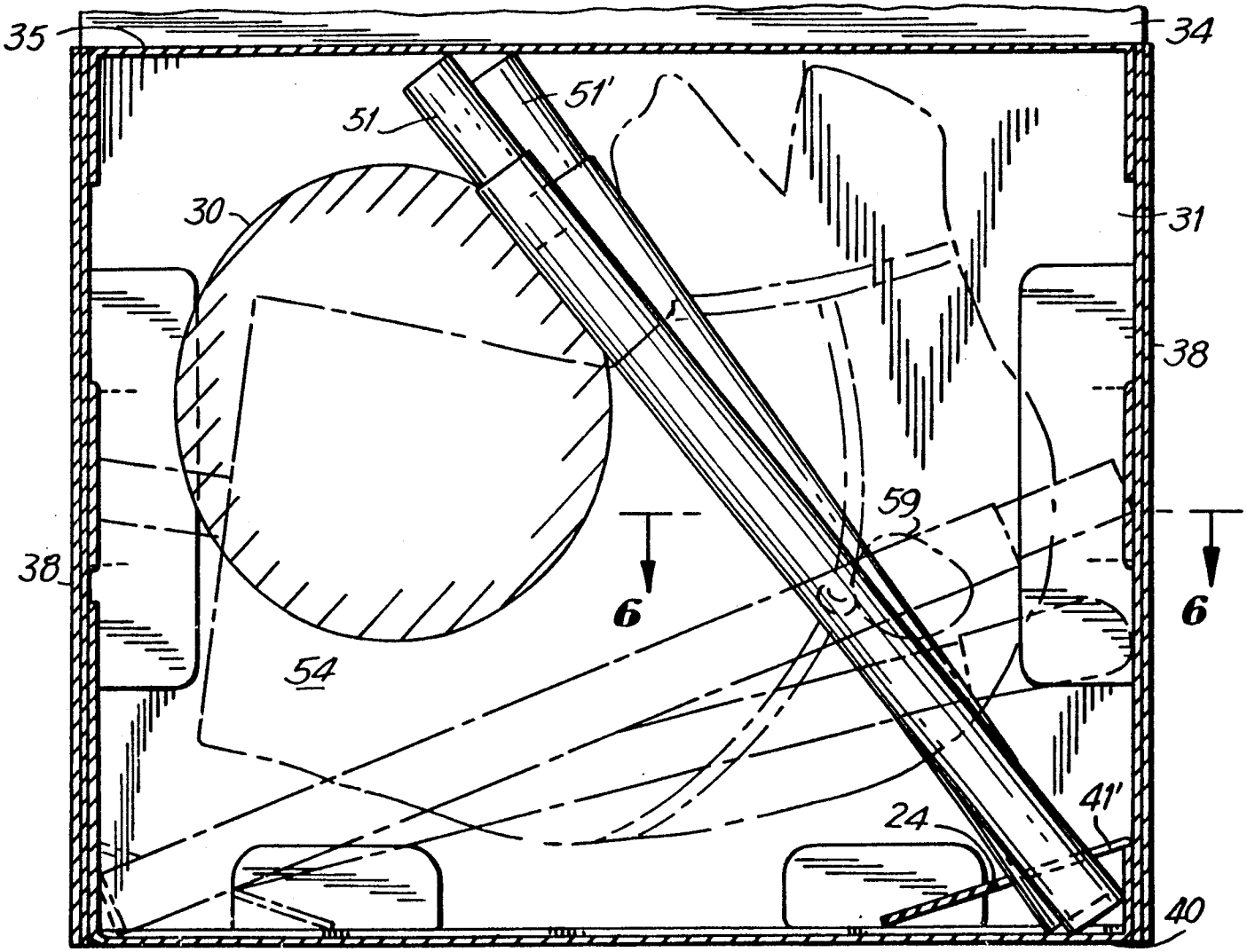
FIG. 5 shows a front cut-away view along section 5—5 of FIG. 3, showing the box, a figurine stored in the compartment, a location of the hobby stick segments and an alternative location of the hobby stick segments of the present invention.

The stand is preferably a box made out of cardboard. Depending on the requirements, it may be a corrugated carton. The preferred material, shown in FIG. 8 is an approximately 1/16 inch laminate of two face sheets 60, 61 and a corrugated inner sheet 62, imprinted with a full color lithograph on one side, shown in FIG. 2 as the outer side with a graphic 50. This structure provides the necessary strength, light weight, attractive appearance, and manufacturability and formability or foldability. The structure, when folded, is self supporting.

Figure 1:
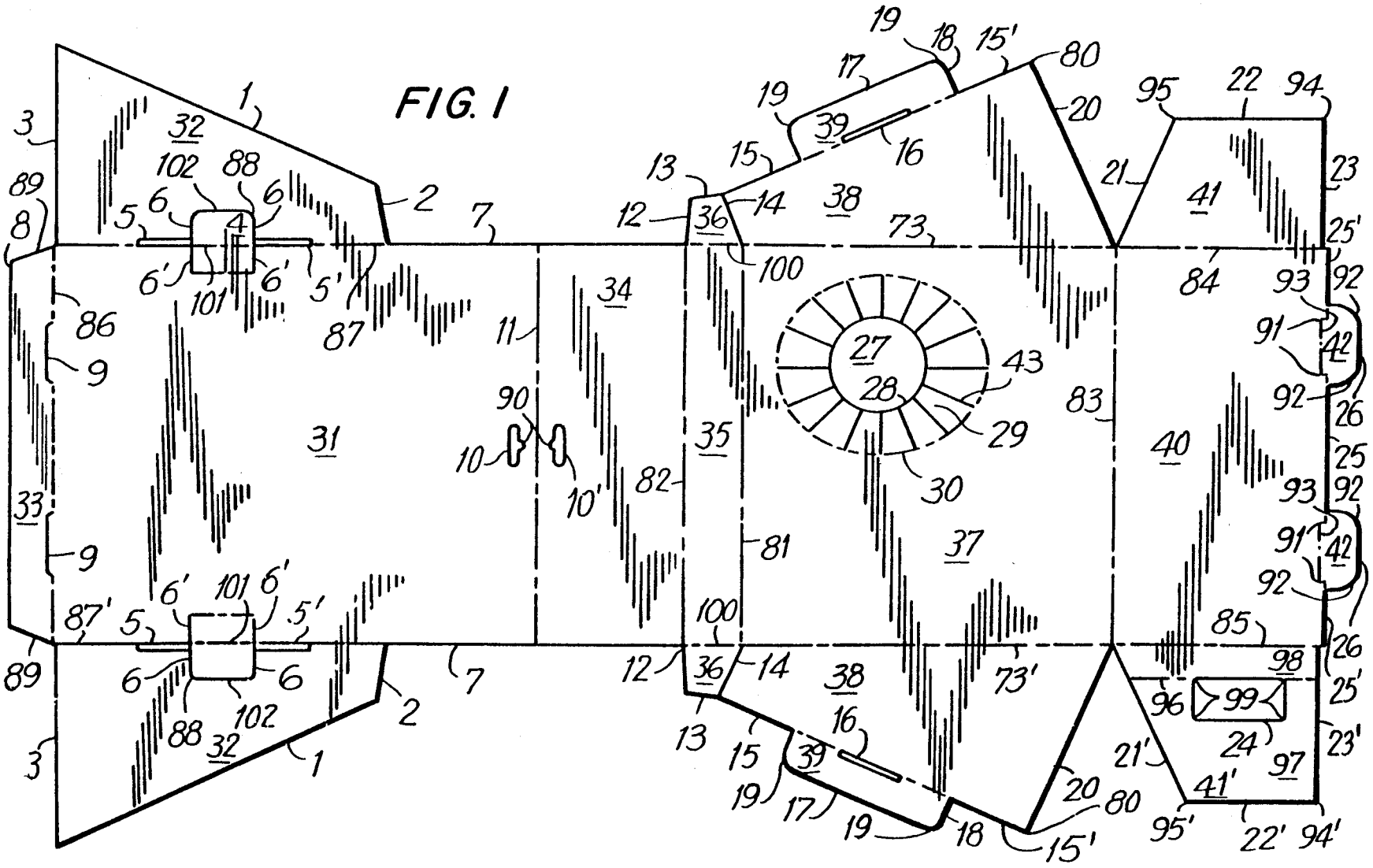
FIG. 1 shows a rear view of a punched, unfolded blank for the box of the present invention.
Figure 2:
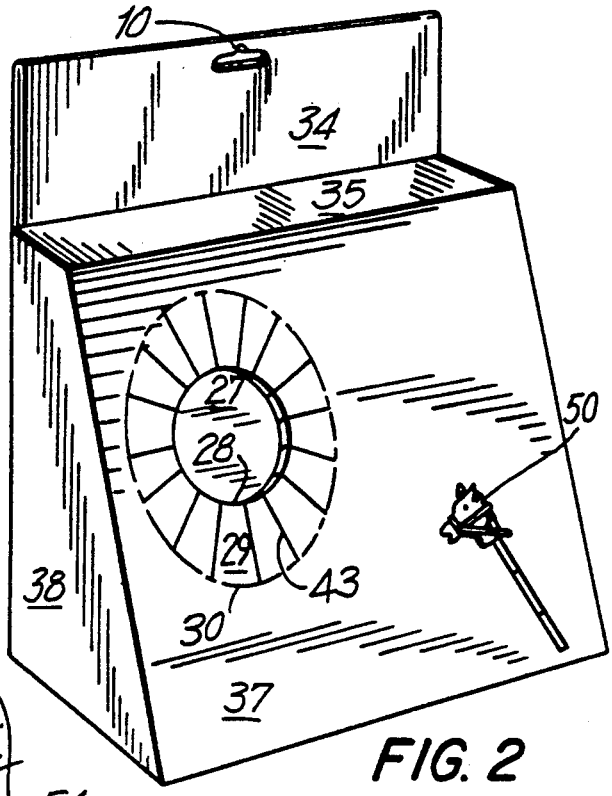
FIG. 2 shows a perspective view of the folded box of the present invention.
Figure 9:
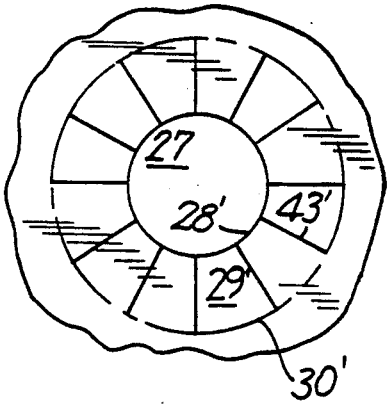
FIG. 9 shows a detail of an alternative embodiment of the retention portion on the face of the box of present invention having a circular defined aperture and secondary aperture.

To secure the figurine in the stand, a cut aperture having a feathered edge 28 is made in the front of the stand, as shown in FIGS. 1 and 2. This cut aperture has a generally round or oval hole cutout 27, with generally radially oriented slits 43 extending a distance away from the cutout 27. The slits 43' as shown in FIG. 9 may be of equal length or, in a preferred embodiment, the distal ends of the slits 43 define an oval 30, while the cutout 27 is a circle. The oval 30, in turn, corresponds to a section of the neck 55 or base of the figurine 54 normal an axis 52 thereof, so that the figurine 54 is held by friction at the defined oval 30 aperture. Further, the round cutout 27 is inwardly expanded to form a plurality of surfaces 29 with an inner edge 28 and an outer hinge at the defined oval 30 aperture. The inner edge 28 may also engage the figurine 54 to provide a racheting function to further secure the figurine 54 against withdrawal. The figurine 54 preferably has a rear protrusion 56 which limits the inward extension of the neck 55 or base into the stand 57.

Figure 4:
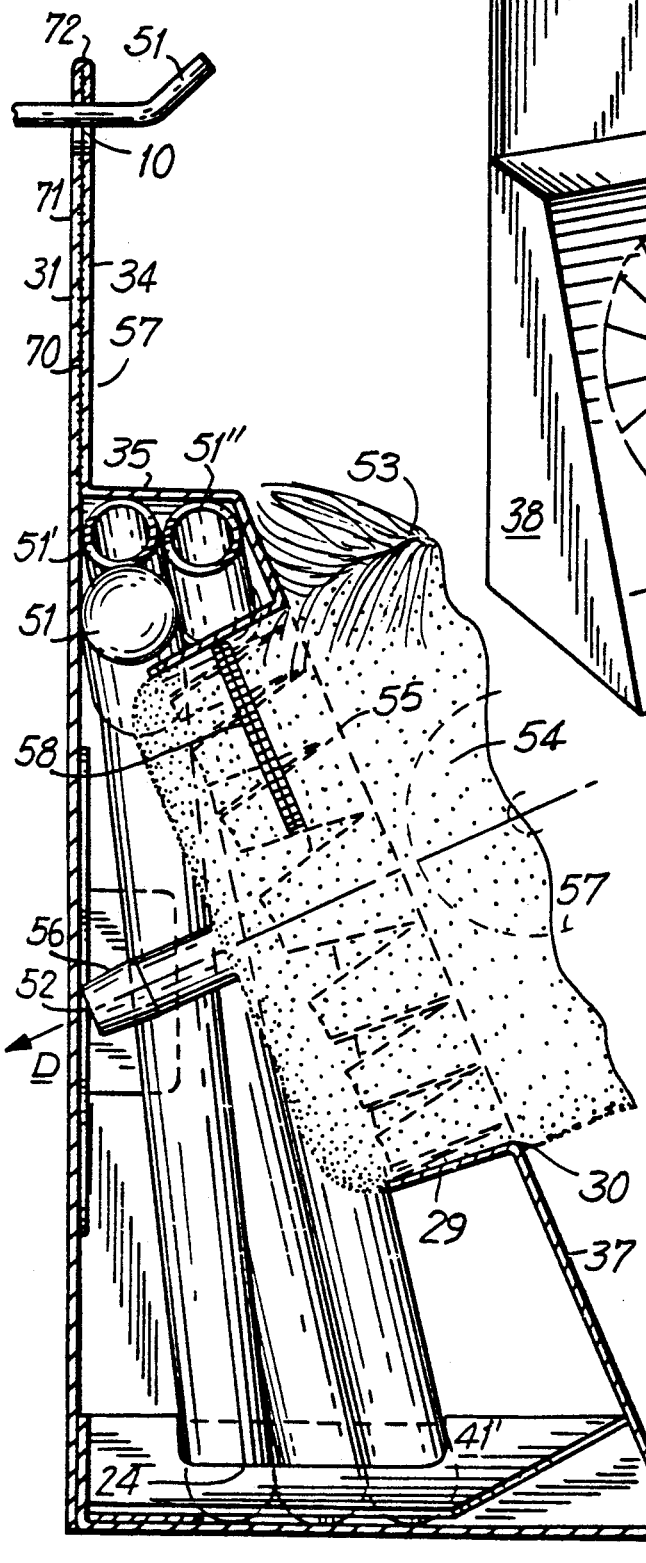
FIG. 4 shows a side cut-away view along section 4—4 of FIG. 3, showing the box, the figurine, and the accessories of the present invention.
Figure 3:
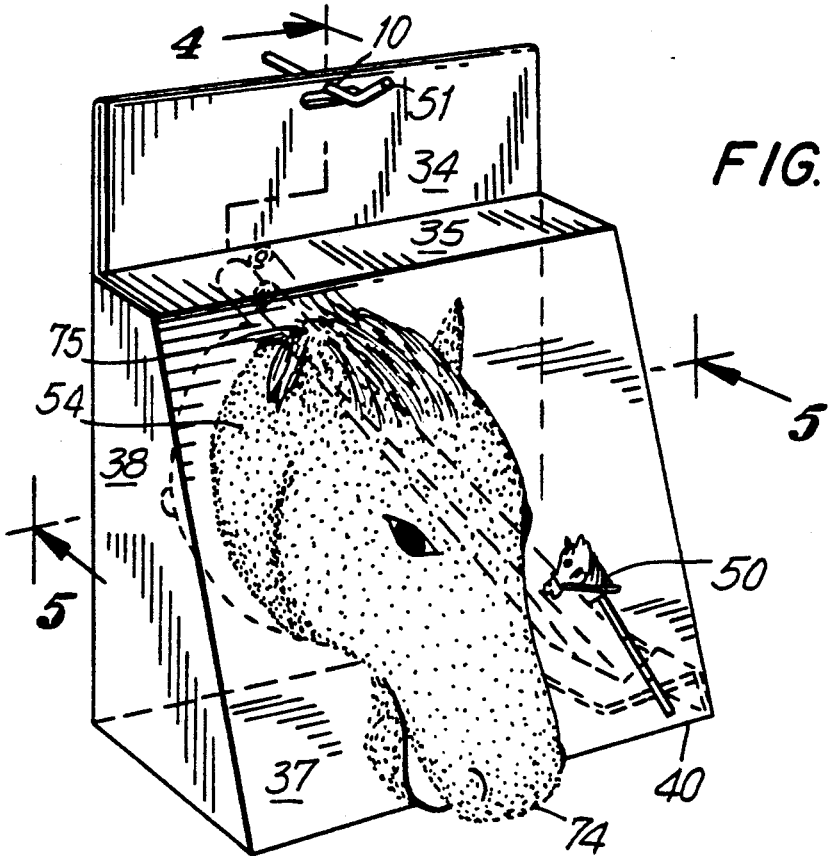
FIG. 3 shows a perspective view of the folded box of the present invention with the horse head figurine inserted and the hobby stick in the compartment.
Figure 7:
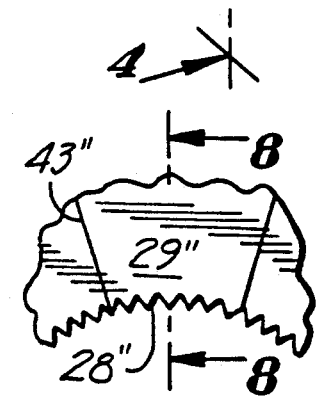
FIG. 7 shows a detail of an alternative embodiment of the retention portion on the face of the box of present invention, having a roughened edge.

In a most preferred embodiment, there are 16 subportions 29 defined by the round cutout 27 aperture and slits 43, which fold inwardly, as shown in FIG. 4. In order to define an oval 30 aperture from the initial round cutout 27, the slits 43 must be of uneven length. In the particularly preferred embodiment, the figurine 54, shown diagrammatically in the Figures, comprises a plush hobby horse wherein the distance from the tip of the snout to the top of the ear is about 10 inches, the distance from the base of the neck portion to the top of the ear is about 9.5 inches, and a dowel pin 56 extends about 1.5 inches axially outward from the base of the neck 55 from a circular plate immediately inside the plush bottom, having a diameter of approximately 4.75 inches. This figurine 54 has two pressure operated momentary electrical switches in the ear 59 portions, which actuate an electronic mechanism, including a speaker 57 located in the neck 55 and head of the figurine. The electronic mechanism is powered by batteries, which are held in a holder in a compartment at the base of the neck 55. This compartment has a nylon zipper closure 58 at a seam in the plush material which extends approximately 180° around the back of the neck 55. The battery holder has two wires which extend through a seam in a sewn battery compartment inner fold to the electronic mechanism.

The base of the neck 55 is generally round, having a diameter of about 5.5 inches along both a mid-sagittal and a mid-coronal plane. A mane portion 53, having hairs approximately 3 inches long, extends along a posterior portion of the neck 55, between the ears 59, and ends at a position approximately 2 inches anterior to the base of the ear. This mane creates a noncircular cross section in the rear portion of the neck 55. The base of the mane 53 follows an approximately parabolic path, which reaches its apex at the superior end of the mane 53. The anterior of the neck 55 is inclined anteriorly in a mid-sagittal plane for an axial distance of approximately 3.5 inches with a rise of approximately 0.75 inch, which equates to an approximately 12° forward pitch. This structure creates a condition at a height of approximately 3 inches from the base of the neck 55 wherein the neck 55 has an oval cross section, with a minor axis of approximately 5.5 inches and a major axis of approximately 6 inches.

The stand 57 is formed in conventional manner from a single piece of die-cut cardboard, as shown in FIG. 1. Because of an interlocking and interfitting design, glue 70 is used only to hold the double-walled extension 31, 34 of the back portion 31 above the top 35 together; the remainder of the box being mechanically assembled by interfitting design.

The stand 57 is designed so that the dowel 56, which is also used for the attachment of the hobby stick, formed of hobby stick segments 51, 51', 51'', contacts the rear wall 31 of the stand 57 when the base of the neck 55 extends approximately 3 inches into the stand 57. Thus, to apply even pressure to retain the figurine 54 and to maintain the axis 52 of alignment of the figurine 54 with the plane of the face 37 of the stand 57, the aperture should also be oval 30. Because the figurine 54 is plush, and in order to provide a secure attachment, the aperture 30 is slightly smaller than the free expanded cross section of the figurine 54 in the plane normal to the axis 52. Thus, the preferred aperture defined by the round cutout 27 and the slits 43 is approximately 5.375 inches by 5.875 inches. The round cutout 27 is approximately circular having a diameter of approximately 3.813 inches.

The stand itself is approximately 6 inches deep and 14 inches high, with square corners at the rear bottom portions thereof. The front portion 37 of the stand 57 is inclined rearwardly at an angle of approximately 26°. The front portion 37 surface ends at a height of approximately 9.75 inches. A top portion 35, approximately 1.625 inches deep and 11.5 inches wide, is provided at an angle of 6° from the base 40, having a rise of approximately 0.188 inch from the front portion 37 to the back portion 31. The back portion 31 extends above the top portion 35 by approximately 4.125 inches. The extension of the back portion 31 is a double walled portion 71, forming a 180° bend at the uppermost point 72. The top portion 35 has two lateral flaps 36 which are defined by a rear edge 12 which is perpendicular to the side edge 7 and extends for a distance of about 1.506 inches, a front edge 14 which is defined by a slit separating it from the side portion 38, extending at an angle of 26° for a distance of 1.625 inches, and a lateral edge 13 which has an angle of about 10° with the side edge 7.

In order to provide a large contiguous area for a graphic 50 and to allow the neck 55 to extend into the stand without interference with the hobby stick 51, 51', 51'', which is divided into three sections each larger than 12 inches, which are interfitting with coaxial friction connections, the aperture 27 is off center in the face of the front portion 37 of the stand 57. In the preferred embodiment, the front portion 37 is approximately 11.5 inches wide, and the aperture has the major axis of the oval 30 approximately 3.5 inches away from the left side of the box, with the edge 28 of the aperture approximately 0.75 inches from the left-most edge 73 of the front portion 37. The right-most edge 28 of the aperture is approximately 5.5 inches from the right-most edge 73' of the front portion 37. In order to provide clearance so that the snout 74 of the hobby horse figurine 54 does not extend below the bottom 40 of the stand 57, and so that the top 75 of the hobby horse figurine 54 is approximately even with the top 35 surface of the stand 57, the oval 30 aperture is formed at a distance of approximately 3.875 inches along the front portion 37 from the bottom 40 and approximately 1.0 inch below the top 35. Thus, the oval 30 aperture is in the upper left corner of the front portion 37 of the stand.

The front portion 37 of the stand 57 has two side portions 38 extending therefrom. The bottom edge 20 of each side portion 38 extends from the lateral sides 73 of the front portion 37 at an angle of 64° for a distance of 5.875 inches when the front portion 37 and the side portion 38 are placed in the same plane. The lateral-most corners 80 of the two side portions 38, when coplanar with the front portion 37, are square. The angle between the upper edge of the side portion defined by the slit 14 and the top edge 81 of the front portion 37 is 116°, which extends for a distance of 1.625 inches so that the lower 20 and upper edges 14 of the side portion 38 are parallel. The lateral edge 15, 15' of the side portion 38 has an angle of 26° outwardly sloping downward. Each side portion 38 has a tab 17 extending therefrom. Each tab 17 is centrally located along the lateral free edge 15, 15' of the side portion 38, extending 1.188 inches from the edge 15, 15', and having rounded corners 19. The tabs 39 is 4.938 inches wide, located about 2.313 inches from both the top 14 and bottom 20 edges. Centered in the tab 39, and located at the junction between the tab 39 and the side portion 38, is a slot 16 approximately 0.188 inches wide by 1.875 inches long, parallel to the lateral edge 15, 15' of the side portion 38.

The rear portion 31 is 11.5 inches wide by 13.75 inches high. Extending from the lateral edges 7 of the rear portion are two side flaps 32 which form an inner sidewall. These flaps 32 extend 5.875 inches from the lateral edge 7 at the bottom edge 3 of the side flap 32 and 1.75 inches at the top edge 2. The bottom of the flap 32 is parallel to the bottom edge 86 of the rear portion 31, while the top edge 2 extends downwardly at approximately 8°. The lateral edges 1 of the side flaps 32 forming an inner sidewall is straight, and extend at an angle of approximately 25°. Each side flap 32 and the rear portion 31 of the stand 57 are separated by a slot 5, 5' approximately 0.125 inch wide by 5.125 inch long, from a distance of 2.125 inches above the bottom edge 86 of the rear portion 31 to a distance 7.375 inches above the bottom edge 86. Each side edge 7 of the rear portion 31 also has a tab 4 extending therefrom extending a distance of 1.125 inches with rounded top and bottom corners 88 and a width of 1.75 inches, formed at a height of 4.0 inches and ending at a height of 5.75 inches above the bottom edge 86, for insertion in the slots 16 between the tab 39 of the side portion 38 and the side portion 38. Parallel to the upper and lower edges of the tab 4 are slits 6, 6' which extend into the rear portion 31 a distance of approximately 0.75 inches. The rear portion 31 also has a bottom tab 33 which extends substantially the entire width thereof, having inwardly tapered sides 89 at an angle of about 25° and a length of extension of about 1.25 inches. The junction between the bottom tab and the rear portion has two slits 9 each starting 1.625 inches from the lateral edge 7 and extending for a distance of 2.25 inches. The slits 9 follow a joggle path as shown in the drawings so that when the bottom tab 33 is folded, slots for insertion of tabs 42 are formed. The rear portion 31 has a keyway slot 10, 10' for support of the stand on a horizontally oriented rod 51 centrally located between 0.438 inches and 0.688 inches from the top edge 11 of the double walled upper extension 71 of the rear portion 31, approximately 1.125 inches wide, with a central semicircular extension 90 extending to a distance of 0.313 inches from the upper edge 11.

The bottom portion 40 of the stand 57 has two tabs 42 extending from a rear edge 25, 25' thereof, each 2.25 inches wide and extending a distance of 1.125 inches with radiused extending corners 92 and relief slits 91 cut at a neck portion of the tabs 42 so that the neck 93 has a width of 1.75 inches. The tabs 42 are located a distance 1.625 inches from the lateral edges 84 of the bottom portion 40, and are each inserted into the slits 9 between the rear portion 31 and the bottom tab 33 during assembly.

The bottom portion 40 also has two side flaps 41, 41' extending from the side edges 84, 85 thereof. The left side flap 41 extends 3.75 inches from the lateral side edge 84 of the bottom portion 40. The rearmost portion of the left side flaps 41 has an edge 23 which is parallel to the rearmost edge 25, 25' of the bottom portion 40. The rear corner 94 is square. The forward-most corner 95 has an angle of approximately 115°, with the forward-most edge 21 intersecting the bottom portion 40 at the junction edge 83 with the front portion 37. The right side flap 41' extends for a distance of 4.75 inches, has a square rearmost corner 94' and a front-most corner 95' with an approximately 115° angle, with the front edge 21' intersecting the bottom portion 40 at the junction edge 83 with the front portion 37. In addition, the right flap 41' is folded to form an edge 96 at a distance of 1.0 inch from the lateral edge 22', so that when folded, the side flap 41' forms a flap 97 in a plane parallel to the bottom portion 40, spaced one inch apart, and a flap 98 which is coplanar to the side portion 38. The side flap 41' also has aperture 24 measuring 2.625 inches parallel to the side edge 22' by 1.25 inches perpendicular to the side edge 22', having radiused corners 99. This aperture 24 may be used for retaining the ends of the three divided sections 51, 51', 51'' of the hobby stick, while stored in the stand 57.

The box or stand 57 is thus assembled by first applying glue 70 adhesive between the two halves of the upper extension 71 of the rear portion 31. The flap 33 extending from the bottom edge 86 of the rear portion 31 is then folded inward. The side flaps 41 of the bottom portion 40 are also folded inward, with the right flap 41' also folded at the edge 96 of the aperture 24 provided therein. The two tabs 42 extending from the rear edge 25, 25' of the bottom portion 40 are then inserted into the two slits 9 formed between the bottom tab 33 of the rear portion 31 and the rear portion 31. The flaps 36 extending from the lateral edges 100 of the top portion 35 are then folded inward. The inner side flaps 32 extending from the lateral edges 7 of the rear portion 31 are folded inward, with the tabs 4 remaining free. The contents, e.g. hobby stick segments 51, 51', 51'', of the enclosure or stand 57 are then inserted, possibly retained by the aperture 24 and the side portions 38 extending from the lateral edges 73 of the front portion 37 are folded into place at right angles to the plane of the front portion 37, with the tabs 39 folded at right angles to the side portions 38 for insertion into the slots 5, 5' formed between the rear portion 31 and the inner side flaps 32. The tabs 4 extending from the rear portion 31, having slits 6, 6' extending into the rear portion 31, are then flexed outward, behind the plane of the rear portion 31, and folded inward along an axis 101 corresponding to the lateral edge 7 of the rear portion 31. The lateral-most edge 102 of the tabs 4 are then inserted into the slot 16 provided between the side portions 38 and the tabs 39 extending therefrom, which have been previously inserted into the slot 5, 5' between the rear portion 31 and the flap 32 forming the inner sidewall. The stand 57 is then completely assembled. The figurine 54 is then pushed into the round cutout 27 in the front portion 37 of the stand in the direction D shown in FIG. 4, whereby the subportions 29 defined by the cutout 27 and the radially oriented slits 43 are displaced inwardly, securing the figurine 54 in place.

It should be understood that the preferred embodiments and examples described herein are for illustrative purposes only and are not to be construed as limiting the scope of the present invention, which is properly delineated only in the appended claims.

What is claimed is:

1. A transport and display stand for a consumer article, comprising:

(a) a generally planar bottom portion having such dimensions to provide stability for the article and stand when the article is supported by the stand, when said bottom portion rests on a planar surface;

(b) a generally planar rear portion extending upward from said bottom portion;

(c) a generally planar front portion extending upward from said bottom portion at an inclination sloping backward toward said rear portion, said front portion having an article retention means comprising an aperture in said front portion defined by an edge and a plurality of slits in said front portion extending from said edge in a direction substantially perpendicular thereto, said slits extending for a distance to define a plurality of subportions of said front portion, each defined by said edge and two adjacent ones of said slits and which may be flexed inwardly from said front portion in the direction of said rear portion, so that the article, when inserted, flexes said subportions inwardly and is retained by said subportions acting against a part of the article;

(d) a top portion, extending between the upper edges of said front and rear portions; and (e) two generally planar side portions, each extending from said bottom portion to said top portion, and from said front portion to said rear portion, said front, rear, top, bottom and side portions defining a closed structure.

2. The stand according to claim 1, wherein said top, bottom, front, rear, and two side portions are formed from a single sheet.

3. The stand according to claim 2, wherein said sheet comprises cardboard, having a graphic imprinted on at least one side thereof.

4. The stand according to claim 1, wherein said article retention means comprises said edge having a path which has a substantially continuous first derivative and said slits extend outwardly in a substantially radial direction from a center of the aperture.

5. The stand according to claim 4, wherein said slits extend a distance approximately equal to a radial distance of the aperture.

6. The stand according to claim 4, wherein the aperture is round and said slits are of different lengths so as to define an oval article retention means which is larger than the round aperture when the article is inserted.

7. The stand according to claim 6, wherein said article retention means is located laterally eccentric in said front portion.

8. The stand according to claim 1, wherein said article retention means comprises said edge having a path which has a substantially discontinuous first derivative and said slits extend outwardly in a generally radial direction from a center of the aperture.

9. The stand according to claim 1, wherein said closed structure comprises a hollow compartment in said stand, at least one of said side portions having a hinge area and being flexible along said hinge area for movement between an open position providing access to said compartment and a closed position in which access to said compartment is not provided.

10. The stand according to claim 9, wherein both of said side portions have hinge areas and are flexible along said hinge areas for movement between an open position and a closed position, said hinge areas joining said front portion and said side portions, said side portions further comprising a slotted aperture formed at a junction of a rear edge of said side portions and a flexible tab protruding from said rearward edge thereof, said rear portion further comprising a tab at each respective lateral edge thereof for engaging said slotted aperture of said side portions.

11. The stand according to claim 10, further comprising inner sidewall portions each comprising a portion which is hinged at, and extends from, said respective lateral edge of said rear portion, a first aperture corresponding to a shape of said tab extending from each respective lateral edge of said rear portion, and a vertical slotted aperture proximate to said respective lateral edge of said rear portion, intersecting said first aperture, so that said inner sidewall portion may be flexed at said respective lateral edge of said rear portion to form an inner sidewall, said sidewall may be flexed at said side hinge areas to form an outer sidewall, said flexible tab may be inserted in said vertical slotted aperture, and said tab may be inserted in said slotted aperture for engaging said side portions locking said stand in said closed position.

12. The stand according to claim 11, wherein said tab at said lateral aspect of said rear portion comprises two horizontal edges, a vertical edge, and two slits parallel to said horizontal edges, forming an elongated tab, a lateral edge hinge and an internal hinge, so that said lateral edge hinge may be displaced out of a plane of said rear portion and said vertical edge may be inserted into said slotted aperture with said lateral edge hinge in said plane of said rear portion.

13. The stand according to claim 12, wherein said bottom portion comprises a rear tab on a rear edge thereof, said back portion comprises a bottom extension extending from a bottom edge thereof, having a horizontal slot in said bottom extension proximate to said bottom edge, for insertion of said rear tab thereinto.

14. The stand according to claim 13, further comprising a second horizontal slot and a second rear tab for insertion thereinto, and two side extensions of said bottom portion extending respectively from two side edges thereof.

15. The stand according to claim 1, wherein said top portion comprises a generally planar surface perpendicular to said rear portion, bounded laterally by said side portions, and said rear portion extends to a position above said top portion approximately coincident with the intersection of a plane of said rear portion and a plane of said front portion.

16. The stand according to claim 15, wherein a part of said rear portion above said top portion comprises a dual folded layer of cardboard having an aperture therein for supporting the stand and the article on a generally horizontal post.

17. The stand according to claim 1, in combination with an animal figurine having a head and a neck, wherein a center of gravity of said stand and said figurine, when inserted in said stand in an upright position, lies within said bottom portion, and said head assumes a physiological position extending from said front portion.

18. A transport and display stand for an animal figurine having a base and a head, comprising:

(a) a generally planar bottom portion having such dimensions to provide stability for the figurine when the base thereof is inserted in the stand, when said bottom portion rests on a planar surface, so that a center of gravity of the stand and the inserted figurine, when the stand is upright, is superimposed on the bottom portion;

(b) a generally planar rear portion extending upward from said bottom portion;

(c) a generally planar front portion extending upward from said bottom portion at an inclination sloping backward toward said rear portion, said front portion having a figurine retention means comprising an aperture in said front portion defined by an edge and a plurality of slits in said front portion extending from said edge in a direction substantially perpendicular thereto, said slits extending for a distance to define a plurality of subportions of said front portion, each defined by said edge and two adjacent ones of said slits and which may be flexed inwardly from said front portion in the direction of said rear portion, so that the base, when inserted, flexes said subportions inwardly and is retained by said subportions acting against a part of the figurine;

(d) a top portion, extending between the upper edges of said front and rear portions; and (e) two generally planar side portions, each extending from said bottom portion to said top portion, and from said front portion to said rear portion, said front, rear, top, bottom and side portions defining a hollow compartment in said stand, at least one of said side portions having a hinge area and being flexible along said hinge area for movement between an open position providing access to said compartment and a closed position in which access to said compartment is not provided.

19. An animal head figurine transport and presentation stand, comprising:

(a) an animal head figurine comprising a head and a neck;

(b) a generally planar bottom portion having such dimensions to provide stability for said figurine when said neck thereof is inserted in said stand, when said bottom portion rests on a planar surface, so that a center of gravity of the stand and said inserted figurine, when said stand is upright, is superimposed on the bottom portion;

(c) a generally planar rear portion extending upward from said bottom portion;

(d) a generally planar front portion, extending upward from said bottom portion at an inclination sloping backward toward said rear portion, said front portion having a figurine retention means comprising an aperture in said front portion defined by an edge and a plurality of slits in said front portion extending from said edge in a direction substantially perpendicular thereto, said slits extending for a distance to define a plurality of subportions of said front portion, each defined by said edge and two adjacent ones of said slits and which may be flexed inwardly from said front portion in the direction of said rear portion, so that said neck, when inserted, flexes said subportions inwardly and is retained by said subportions acting against a part of said figurine;

(e) a top portion, extending between the upper edges of said front and rear portions; and (f) two generally planar side portions, each extending from said bottom portion to said top portion, and from said front portion to said rear portion, said front, rear, top, bottom and side portions defining a hollow compartment in said stand, at least one of said side portions having a hinge area and being flexible along said hinge area for movement between an open position providing access to said compartment and a closed position in which access to said compartment is not provided.

20. The animal head figurine transport and presentation stand according to claim 19 further comprising accessories for said figurine, said accessories being stored in said compartment when said side portions are in said closed position, and said accessories being removable from said compartment when said side portions are in said open position.

21. The animal head figurine transport and presentation stand according to claim 19, wherein said figurine may be inserted into said compartment.

22. The animal head figurine transport and presentation stand according to claim 19, further comprising an extension of said bottom portion having an aperture for retaining accessories for said figurine, so that when said extension having the aperture is folded inside said compartment, and the accessories are mounted therein, the accessories are prevented from shifting within said compartment.

* * * * *